United States Patent [19]

DePaul

[11] Patent Number: 4,872,609

[45] Date of Patent: Oct. 10, 1989

[54] CARTON AND BLANK FOR PACKAGING ICE CREAN OR THE LIKE

[75] Inventor: Richard E. DePaul, West Chester, Pa.

[73] Assignee: Somerville Packaging Corporation, Newport News, Va.

[21] Appl. No.: 262,948

[22] Filed: Oct. 26, 1988

Related U.S. Application Data

[62] Division of Ser. No. 177,319, Apr. 4, 1988, Pat. No. 4,826,074, which is a division of Ser. No. 21,649, Mar. 4, 1987, Pat. No. 4,756,470.

[51] Int. Cl.[4] ..... B65D 5/02

[52] U.S. Cl. ..... 229/134; 53/467; 229/145; 229/169; 229/905; 493/128; 493/162

[58] Field of Search ..... 53/456, 458, 467; 493/52, 128, 162; 229/141, 145, 150, 152, 169, 180, 905, 132, 134; 206/611, 624, 626

[56] References Cited

U.S. PATENT DOCUMENTS

| | | | |
|---|---|---|---|
| 3,315,870 | 4/1967 | Barnes | 206/624 |
| 3,361,328 | 1/1968 | Buttery | 206/624 |
| 3,443,354 | 5/1969 | Lindstrom | 493/162 |
| 3,735,916 | 5/1973 | Buttery | 206/64 |
| 3,833,165 | 9/1974 | Hoiles | 206/624 |
| 3,934,791 | 1/1976 | Dick et al. | 229/134 |
| 4,555,027 | 11/1985 | Froom | 206/626 |
| 4,669,614 | 6/1987 | Froom | 53/467 |
| 4,712,730 | 12/1987 | Froom | 206/626 |

*Primary Examiner*—Gary Elkins

*Attorney, Agent, or Firm*—Shlesinger & Myers

[57] ABSTRACT

The present invention discloses a blank and carton for packaging ice cream or the like comprising hingedly connected cover, rear, bottom and front panels. Left and right end flaps extending from each of the cover, rear, bottom and front panel end flaps. A pocket means formed in each of the carton ends for receiving a portion of the cover panel end flaps adjacent the rear panel for reforming the carton subsequent to the initial opening thereof. The pocket means includes rear panel end flaps forming exterior liners and the corresponding front and bottom panel end flaps forming interior liners. Membrane flaps are hingedly connected to the front panel and left and right front panel end flaps for forming a substantially continuous lip along a portion of the outer periphery of the carton.

65 Claims, 11 Drawing Sheets

FIG 4
PRIOR ART
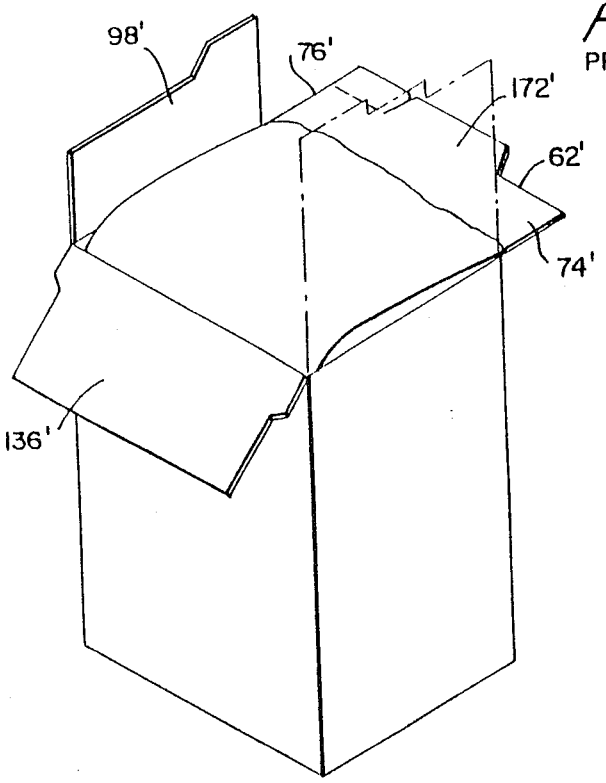
FIG 5
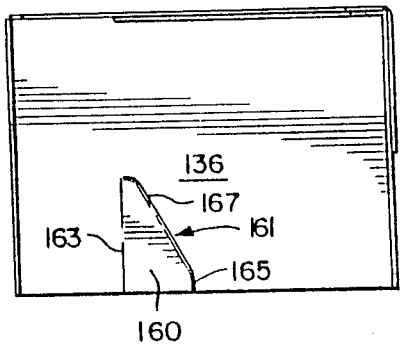
FIG 6
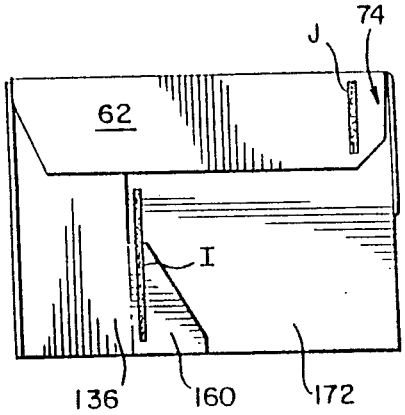
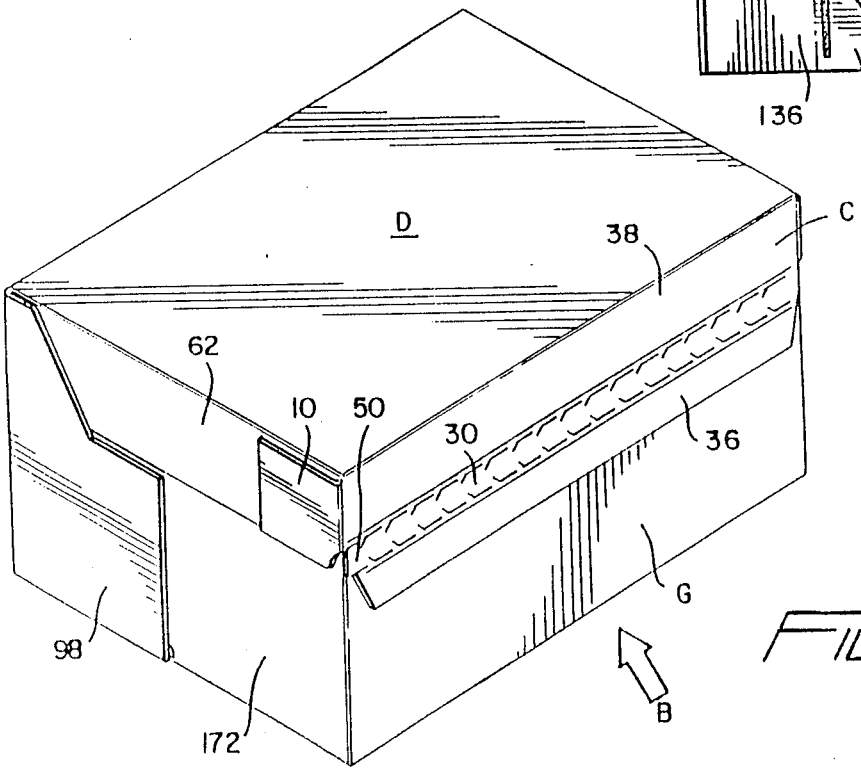
FIG 7

FIG 12
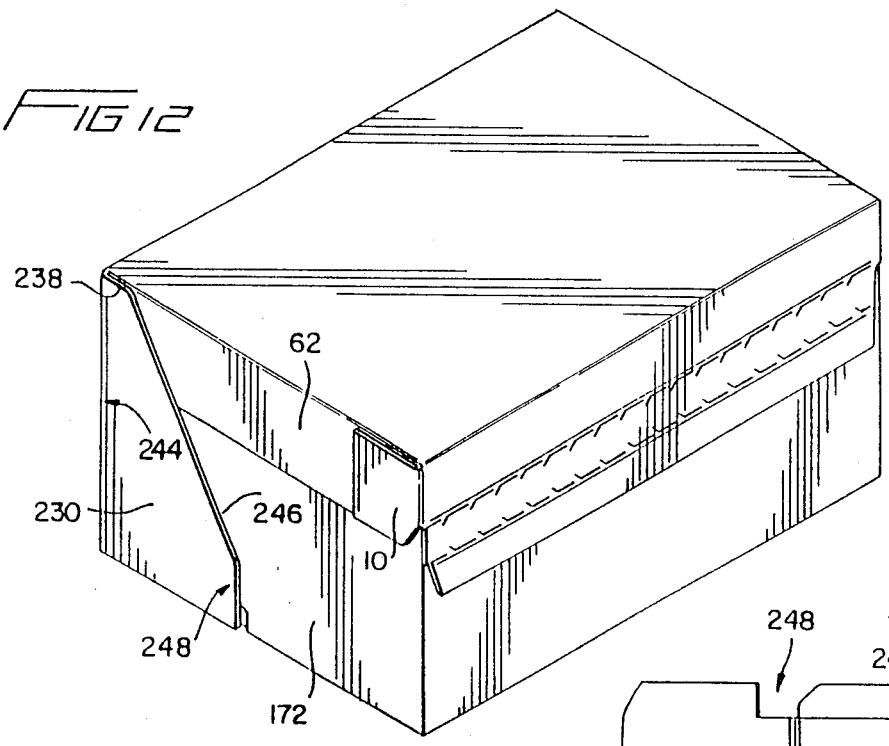
FIG 13
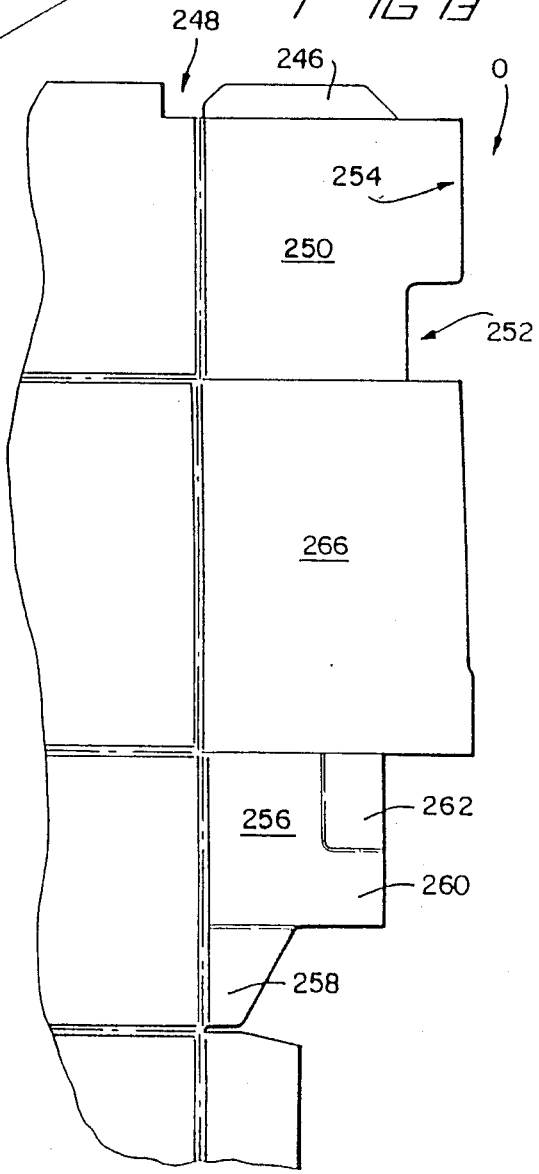
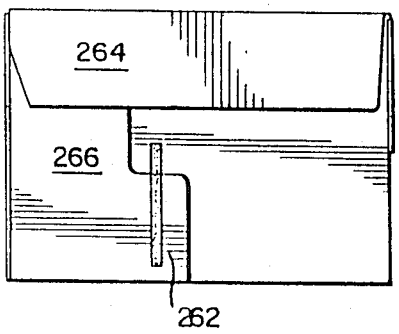
FIG 14
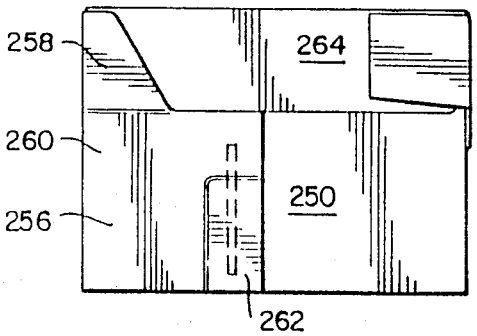
FIG 15

CARTON AND BLANK FOR PACKAGING ICE CREAN OR THE LIKE

This is a division of application Ser. No. 177,319, filed Apr. 4, 1988, U.S. Pat. No. 4,826,074 05/02/89 which is a division of application Ser. No. 021,649, filed Mar. 4, 1987, Pat. No. 4,756,470 07/12/88

FIELD OF THE INVENTION

This invention pertains to a blank and a carton for packaging semi-liquids such as ice cream or the like. Specifically, a design for a carton blank that permits a consumer to readily reseal the carton subsequent to the initial opening thereof.

BACKGROUND OF THE INVENTION

A variety of designs for carton blanks have been proposed for enabling the consumer to reseal the carton subsequent to the initial opening thereof so that the carton can be readily stored. Further, numerous carton blanks have been suggested for improving the overall seal of the blank when fully erected, the adaptability of the carton blank to mechanical erecting devices, and the minimization of scrap stock material from which the blanks are formed. The following U.S. Pat. Nos. are indicative of the previously known designs for carton blanks: 1,509,383 Walter; 2,342,198 Hultin; 2,367,008 Davidson; 2,367,780 Inman; 2,369,385 Carruth; 2,496,043 Farrell; 3,040,957 Meyers; 3,097,783 Burt et al; 3,109,577 Knipp; 3,144,980 Larson; 3,168,233 Ignell; 3,194,479 Rumberger; 3,195,800 Cote; 3,197,114 Holmes; 3,206,103 Bixler; 3,206,915 Anderson; 3,265,285 Fanter; 3,281,055 Buttery; 3,309,834 Buttery; 3,543,997 Michetti; 3,833,165 Hoiles; 4,046,313 Perry; 4,084,489 Matovich; 4,239,115 Froom; 4,256,526 McDaniel; 4,555,027 Froom Prior to the present invention, the packaging industry has been unable to develop a carton for packaging semi-liquids such as ice cream or the like that is readily resealed subsequent to the initial opening thereof and includes carton ends providing substantially continuous surfaces for facilitating printing thereon.

OBJECTS AND SUMMARY OF THE INVENTION

Accordingly, it is an object of the present invention to provide an improved blank and carton for packaging semi-liquids such as ice cream or the like.

Another object of the invention is to provide a carton blank that can be readily erected by mechanical means without residue from the contents contained therein forming on the outer surface of the carton blank.

Another object of the invention is to provide a carton that can be manufactured in multiples, from web or sheet stock, with minimum waste or scrap produced during the blanking operation and efficient nesting of one blank against another.

Yet another object of the invention is to provide a carton, for packaging semi-liquids such as ice cream or the like with a superior seal.

A further object of the invention is to provide a carton that can be readily resealed after the initial opening of the same.

A further object of the invention is to provide a carton including ends having a substantially continuous surface for facilitating printing thereon.

Yet another object of the invention is to provide a carton blank with staggere vertically extending hinge lines formed intermediate the carton body panels and the corresponding end flaps for reducing the stress thereon upon sealing of the carton ends.

In summary, the present invention discloses a novel design for a carton blank including membranes extending from the front panel end flaps and the front panel for forming a substantially continuous lip about a portion of the outer periphery of the carton.

DESCRIPTION OF THE DRAWINGS

FIG. 4 is a perspective view of a prior art ice cream carton filled with ice cream and having the top end open.

FIG. 5 is a side elevation view of the left end of the carton with only the bottom panel end flap folded inwardly.

FIG. 6 is a side elevation view of the left end of the carton depicting the end flaps folded inwardly with the exception of the rear panel end flap.

FIG. 7 is a perspective view of the sealed carton.

FIG. 12 is a perspective view of the sealed carton formed in accordance with the second embodiment of the present invention.

FIG. 13 is a fragmentary plan view of the inner surface of a third embodiment of a flat carton blank formed in accordance with the present invention.

FIG. 14 is a side elevation view of the left end of the third embodiment of the carton depicting the end flaps folded inwardly with the exception of the rear panel end flap.

FIG. 15 is a side elevation view of the third embodiment of the carton depicting the left carton end sealed.

DETAILED DESCRIPTION OF THE INVENTION FIG. 1

Figure 1:
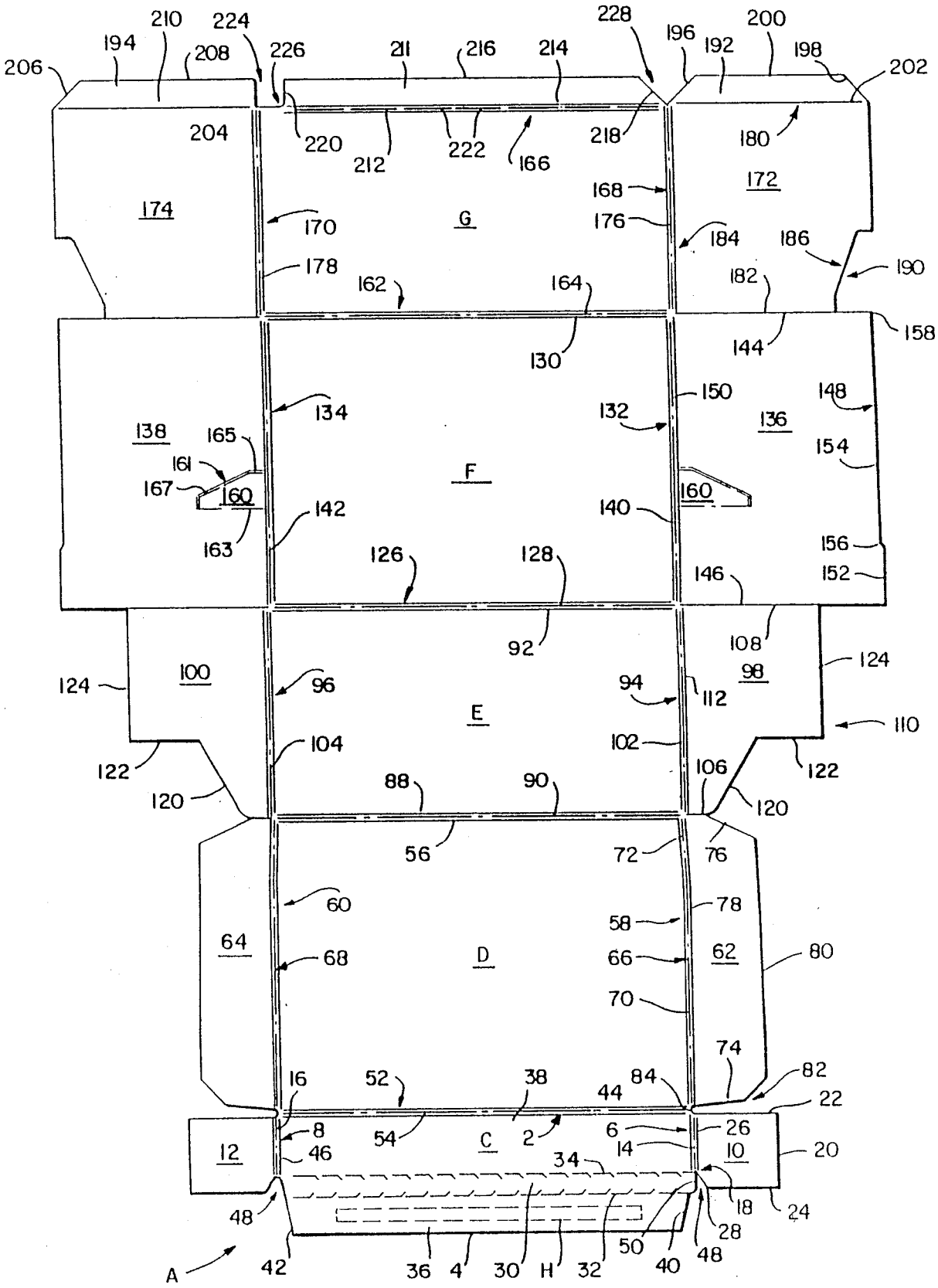
FIG. 1 is a plan view of the inner surface of a flat carton blank formed in accordance with the present invention

The specific nomenclature assigned to each component and subcomponent comprising carton blank A refers to its orientation when carton blank A is fully erected and as viewed in the direction of arrow B in FIG. 7. Referring to FIG. 1, carton blank A is comprised of a closure flap C, a cover panel D, a rear panel E, a bottom panel F, and a front panel G. Closure flap C includes a top edge 2, a bottom edge 4, a left edge 6 and a right edge 8. Left and right cover or glue tabs 10 and 12 are hingedly connected to left and right edges 6 and 8 respectively forming vertically extending hinge lines 14 and 16 therebetween. Cover tabs 10 and 12 include front edge 18, rear edge 20, top edge 22 and bottom edge 24. Front edge 18, includes first and second portions 26 and 28. First portion 26 extends parallel to the corresponding hinge lines 14 and 16. Second portion 28 extends outwardly from first portion 26 and forms an obtuse angle less than 180° therewith. A tear strip 30 is formed in closure flap C and includes spaced weakness lines 32 and 34. Weakness lines 32 and 34 subdivide closure flap C into a glue panel or segment 36 and a skirt or resealable flap 38. Glue segment 36 includes a left end 40 and right end 42. Skirt 38 includes left and right ends 44 and 46 respectively. Left and right ends 44 and 46 extend substantially parallel to the corresponding hinge lines 14 and 16. Left and right ends 40 and 42 extend inwardly from left and right ends 44 and 46 respectively and form an obtuse angle therewith less than 180°. Thus, a notch or recess 48 is formed intermediate left and right ends 40 and 42 and the associated second portion 28 of glue tabs 10 and 12. Left edge 40 of glue segment 36 is formed inwardly from left end 44 of skirt 38 thereby forming tear tab 50. This arrangement of tear strip 30 enables a consumer to readily detach the cover panel D from the front panel G to gain access to the contents of the carton. It will be appreciated by one of ordinary skill in the art that various other types of tear tabs and tear strips may be used.

Cover panel D is hingedly connected at its front edge 52 to top edge 2 of closure flap C forming horizontally extending hinge line 54. Cover panel D further includes rear edge 56, left edge 58, and right edge 60. End flaps 62 and 64 are hingedly connected to left and right edges 58 and 60 respectively forming vertically extending hinge lines 66 and 68 therebetween. Vertically extending hinge lines 66 and 68 include first and second segments 70 and 72. First segment 70 is substantially perpendicular to hinge line 54 formed intermediate closure flap C and cover panel D. Second segment 72 extends inwardly from first segment 70 forming an obtuse angle therewith of less than 180°.

Cover panel end flaps 62 and 64 include front, rear, top, and bottom edges 74, 76, 78 and 80 respectively. Front edges 74 are spaced from the associated top edges 22 of glue or cover tabs 10 and 12 forming a notch 82 therebetween. Notches or recesses 82 include an arcuate radius 84 formed adjacent horizontally extending hinge line 54. Front edges 74 of cover panel end flaps 62 and 64 form acute angles with hinge lines 66 and 68 respectively.

Rear panel E is hingedly connected at its top edge 88 to rear edge 56 of cover panel D forming horizontally extending hinge line 90 therebetween. Rear panel E further includes bottom edge 92, left edge 94, and right edge 96. Rear panel end flaps 98 and 100 are hingedly connected to left and right edges 94 and 96 of rear panel E respectively. Vertically extending hinge lines 102 and 104 are formed therebetween.

Rear panel end flaps 98 and 100 are defined by top edges 106, bottom edges 108, front edges 110, and rear edges 112. Front edges 110 of rear panel end flaps 98 and 100 include first, second and third portions 120, 122, and 124 respectively. First portion 120 forms an obtuse angle less than 180° with top edge 106. Second portion 122 forms an obtuse angle with first portion 120 greater than 180° and extends substantially parallel to bottom edge 108. Third portion 124 forms a substantially right angle with second portion 122 and extends parallel to rear edge 112. Vertically extending hinge lines 102 and 104 are substantially aligned with first segments 70 of hinge lines 66 and 68 respectively and are offset from second segments 72. The second segments 72 are tapered inwardly to enhance the seal of the left and right rear corners of the carton.

Bottom panel F at its rear edge 126 is hingedly connected to bottom edge 92 of rear panel E forming horizontally extending hinge line 128 therebetween. Bottom panel F further includes front edge 130, left edge 132 and right edge 134. End flaps 136 and 138 are hingedly connected to left and right edges 132 and 134 respectively. Vertically extending hinge lines 140 and 142 are formed therebetween. Vertically extending hinge lines 140 and 142 are inwardly offset from hinge lines 102 and 104 respectively Rear panel end flaps 136 and 138 are defined by front, rear, top and bottom edges 144, 146, 148 and 150 respectively. Top edge 148 includes first and second portions 152 and 154. First portion 152 extends substantially parallel to bottom edge 150. Second portion 154 is inwardly offset from first portion 152 and is tapered such that end 156 of first portion 152 extends a distance from bottom edge 150 greater than end 158 extends therefrom. This configuration of top edge 148 of bottom panel end flaps 136 and 138 permit second portions 154 to act as cam surfaces. This feature will be more fully discussed below with reference to the assembly of the carton blank. Raised or offset sections 160 are formed in bottom panel end flaps 136 and 138 adjacent bottom edges 150. Offset portions 160 are substantially triangular in shape.

Front panel G is hingedly connected at its bottom edge 162 to front edge 130 of bottom panel F forming horizontally extending hinge line 164 therebetween. Front panel G further includes top edge 166, left edge 168, and right edge 170. End flaps 172 and 174 are hingedly connected to left and right edges 168 and 170 of front panel G respectively forming vertically extending hinge lines 176 and 178 therebetween. Hinge lines 176 and 178 are substantially aligned with hinge lines 102 and 104 respectively and offset from hinge lines 132 and 134 respectively.

Front panel end flaps 172 and 174 are defined by top edge 180, bottom edge 182, front edge 184, and rear edge 186. Rear edge 186 has cut-out 190 formed therein adjacent bottom edges 182. Cut-out 190 has a configuration substantially similar to raised or offset portions 160 of bottom panel end flaps 136 and 138.

Front panel end flap membranes 192 and 194 are hingedly connected to top edges 180 of front panel end flaps 172 and 174 respectively. End flap membrane 192 is defined by front edge 196, rear edge 198, inner edge 200 and outer edge 202. Front edge 196 extends outwardly from hinge line 176 and forms an obtuse angle therewith of about 135°. Rear edge 198 forms an obtuse angle with inner edge 200 less than 180°. End flap membrane 194 includes front edge 204, rear edge 206, inner edge 208, and outer edge 210. Front edge 204 is substantially aligned with vertically extending hinge line 178. Rear edge 206, similar to rear edge 198 of end flap membrane 192, forms an obtuse angle with inner edge 208.

Front panel membrane 211 is hingedly connected to top edge 166 of front panel G forming therebetween a horizontally extending hinge line 212. Front panel membrane 211 is defined by front edge 214, rear edge 216, left edge 218, and right edge 220. Hinge line 212 includes a plurality of slits 222 that extend completely through the thickness of the carton blank A. The function of slits 222 will be more fully discussed below. Right edge 220 is offset inwardly from hinge line 178 a distance equal to the length of front edge 204 of end flap membrane 194. Thus, a substantially rectangular shaped notch 224 is formed between front panel membrane 211 and end flap membrane 194. A radius 226 is formed in the corner of notch or recess 224 adjacent right edge 220 of front panel membrane 211. Left edge 218 extends inwardly from hinge line 176 and forms an angle of 135° therewith. A substantially V-shaped notch or recess 228 is formed between front panel membrane 211 and end flap membrane 192. Although the edges 196 and 218 are cut along a 45° angle, it would be obvious to one of ordinary skill in the art that edges 196 and 218 could be cut along any pair of complimentary angles, such as 60° and 30°.

An adhesive H in the form of a strip or other well known form is applied to glue segment 36 of closure flap C. Referring to FIG. 6, a single adhesive strip I is applied to bottom panel end flap 136 along raised or offset portion 160 and an adjacent portion of front panel end flap 172. In a similar manner, an adhesive strip is applied to bottom panel end flap 138 along raised or offset portion 160 and an adjacent portion of front panel end flap 174 (not shown). An adhesive strip J is applied to cover panel end flap 62 adjacent its front edge 74. Similarily, an adhesive strip J is applied to cover panel end flap 64 adjacent front edge 74 (not shown).

Figure 2:
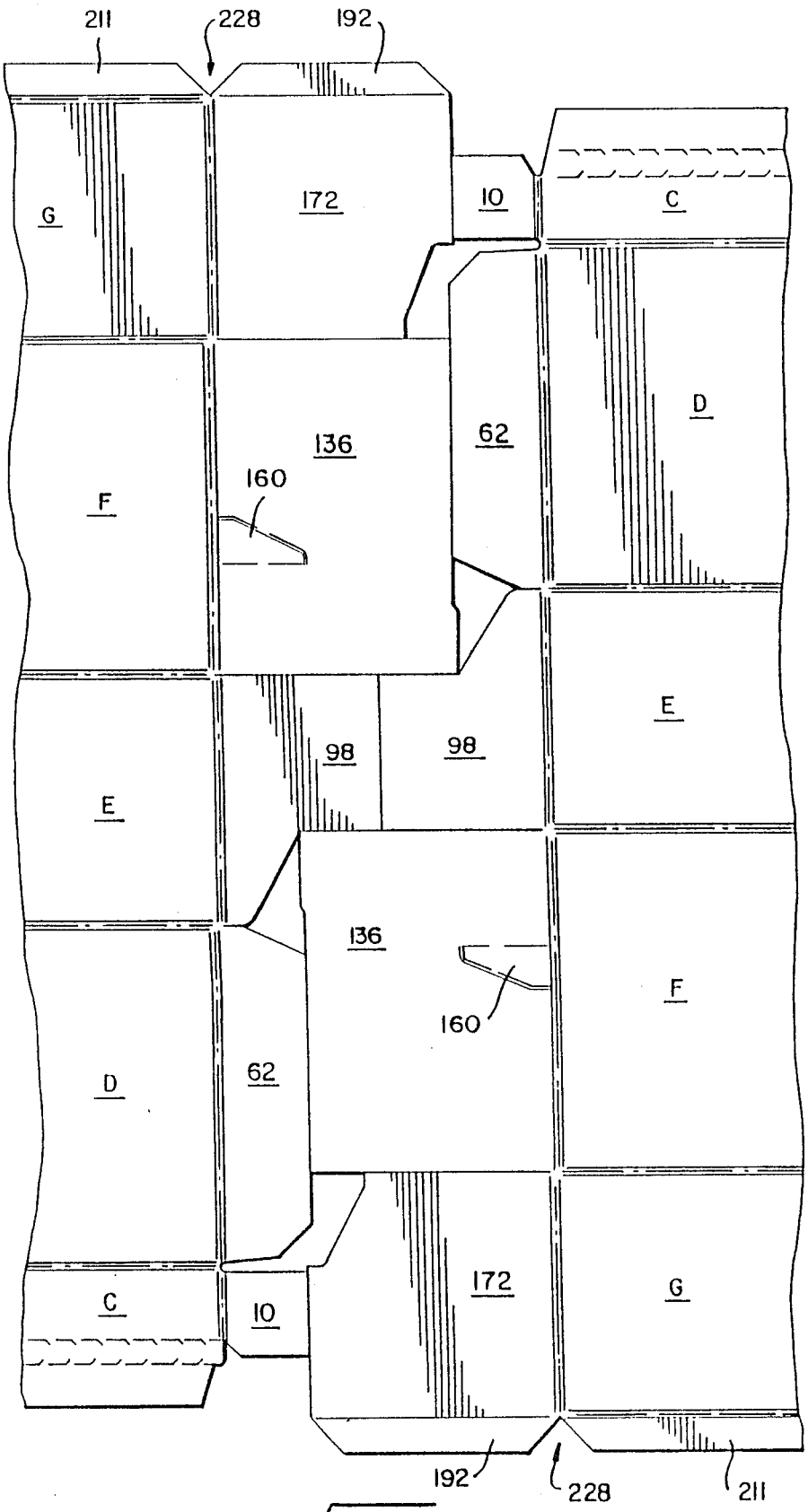
FIG. 2 is a fragmentary plan view of a pair of carton blanks illustrating their orientation during the blanking operation.

Referring to FIG. 2, a pair of blanks are illustrated as oriented during the blanking operation. As is evident from the drawing, the end flaps have been designed to reduce the amount of scrap stock produced during the blanking operation and to create an efficient layout by nesting adjacent blanks.

CARTON ASSEMBLY FIGS. 1, 3A, 3B, and 4 through 7

Figure 3A:
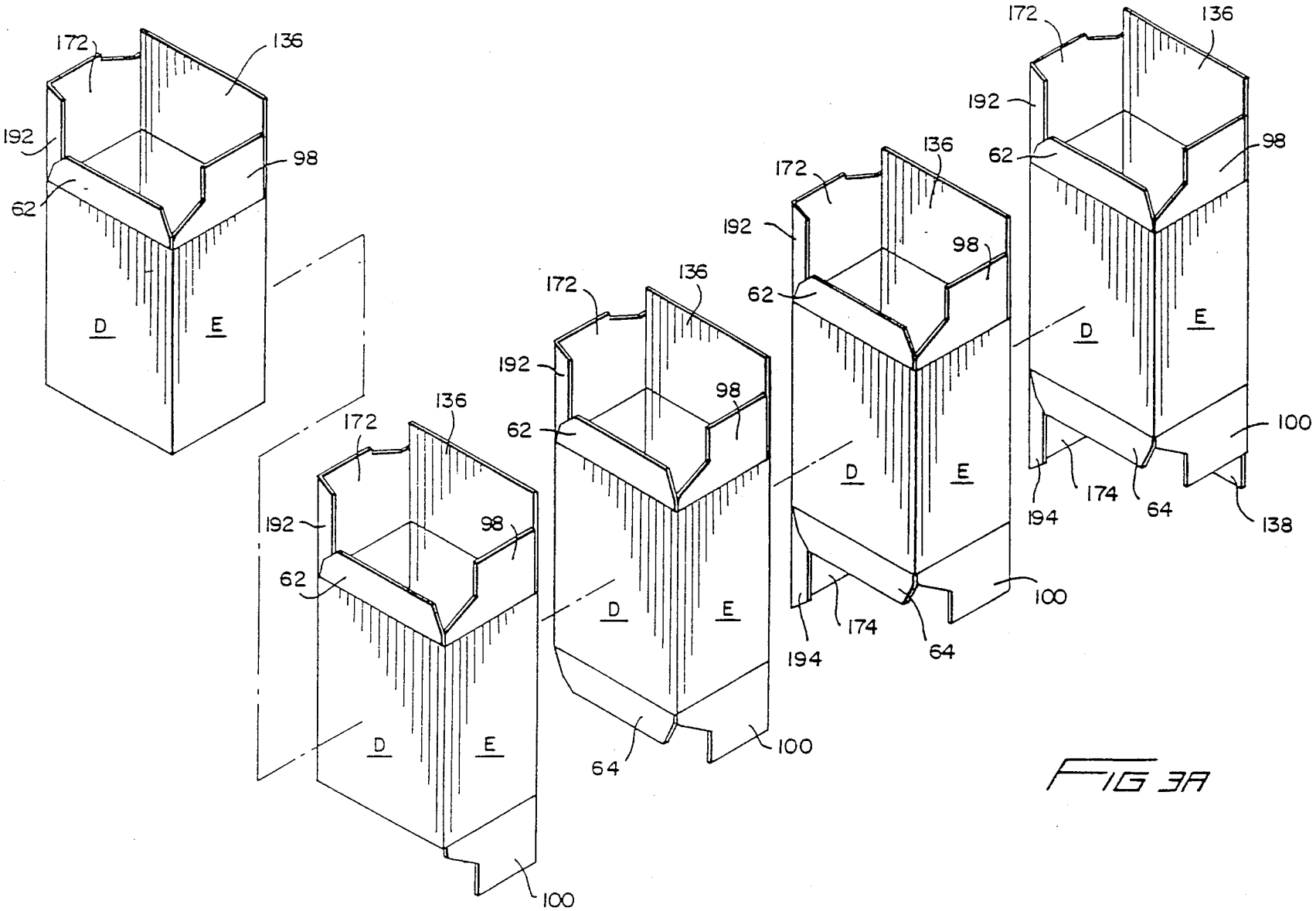
FIGS. 3A and B are perspective views of the filling and assembly process of the blank.

The specific steps taken to assemble the blank A will now be described. Initially, the front panel G is folded about hinge line 164 such that it lies on a portion of bottom panel F. Cover panel D and closure flap C are folded about hinge line 90 such that cover panel D overlies rear panel E, a portion of bottom panel F and front panel membrane 211. Closure flap C overlies a portion of front panel. The front edges 74 of cover end flaps 62 and 64 overlie a portion of end flap membranes 192 and 194 respectively. Pressure is applied to closure flap C to securely fasten it to front panel G. At this stage in the assembly process, the blank A is placed into the hopper of cartoner; i.e. a mechanical machine for erecting carton blanks. The hopper of the cartoner is designed to hold approximately 250 blanks oriented in such a manner that the cover, rear, bottom and front panels are vertically positioned. The individual blanks are removed from the hopper opened and squared, as best seen in FIG. 3A. In this step, the membrane flaps 192, 194 and 211 are folded to lie in a plane substantially parallel with the cover panel D. Prior designs for cartons employing membrane flaps hingedly connected to the front panel and left and right front panel end flaps have experienced a high stress concentration at hinge lines 54 and 166. As a result, this step of erecting the body panels has been more difficult and has led to tears and severe weakness points about the top front edge of the carton. The present invention has provided a plurality of slits 222 extending completely through hinge line 212 and further has offset hinge line 212 inwardly from top edges 180 of front panel end flaps 172 and 174. This feature permits the body panels to be readily erected without experiencing any undue stress on the carton.

The blank A with the body panels erected and end flaps extending substantially planar to the corresponding body panels, is positioned to move through the cartoner with the cover panel D leading. The cartoner performs all folding steps to the lower or left end flaps, including the application of adhesive, prior to filling. Specifically, bottom panel end flap 138 is folded inwardly so that it is substantially perpendicular with bottom panel F. Subsequently, the front panel end flap 174 is folded inward such that end flap membrane 194 is biased upwardly against cover panel D by cam surface 154 of bottom panel 138. Front panel 174 overlies a portion of bottom panel 138. Cut-out 190 of front panel 174 cooperates with raised or offset portion 160 of bottom panel end flap 138 such that raised portion 160 is substantially planar with front panel end flap 174, as best seen in FIG. 6.

Cover panel end flap 64 is folded inward to overlie front panel end flap 174 and bottom panel end flap 138. Adhesive strip I is applied to bottom panel end flap 138 along raised portion 160 and an adjacent portion of front panel end flap 174. Subsequently, rear panel end flap 100 is folded inwardly to overlie cover panel end flap 64, bottom panel end flap 138 and front panel end flap 174. A force is applied to rear panel end flap 100 adjacent its bottom edge to fasten rear panel end flap 100 to bottom panel end flap 138 and front panel end flap 174. Raised portion 160 provides a substantially planar surface between bottom panel end flap 138 and front panel end flap 174 to securely fasten the rear panel end flap 100 to the bottom panel end flap 138 and front panel end flap 174. The cover or glue tab 12 is folded inwardly to overlie cover panel end flap 64 and a force is applied thereto to secure the same to cover panel end flap 64. The left or lower end of the carton K is thus sealed.

Figure 3B:
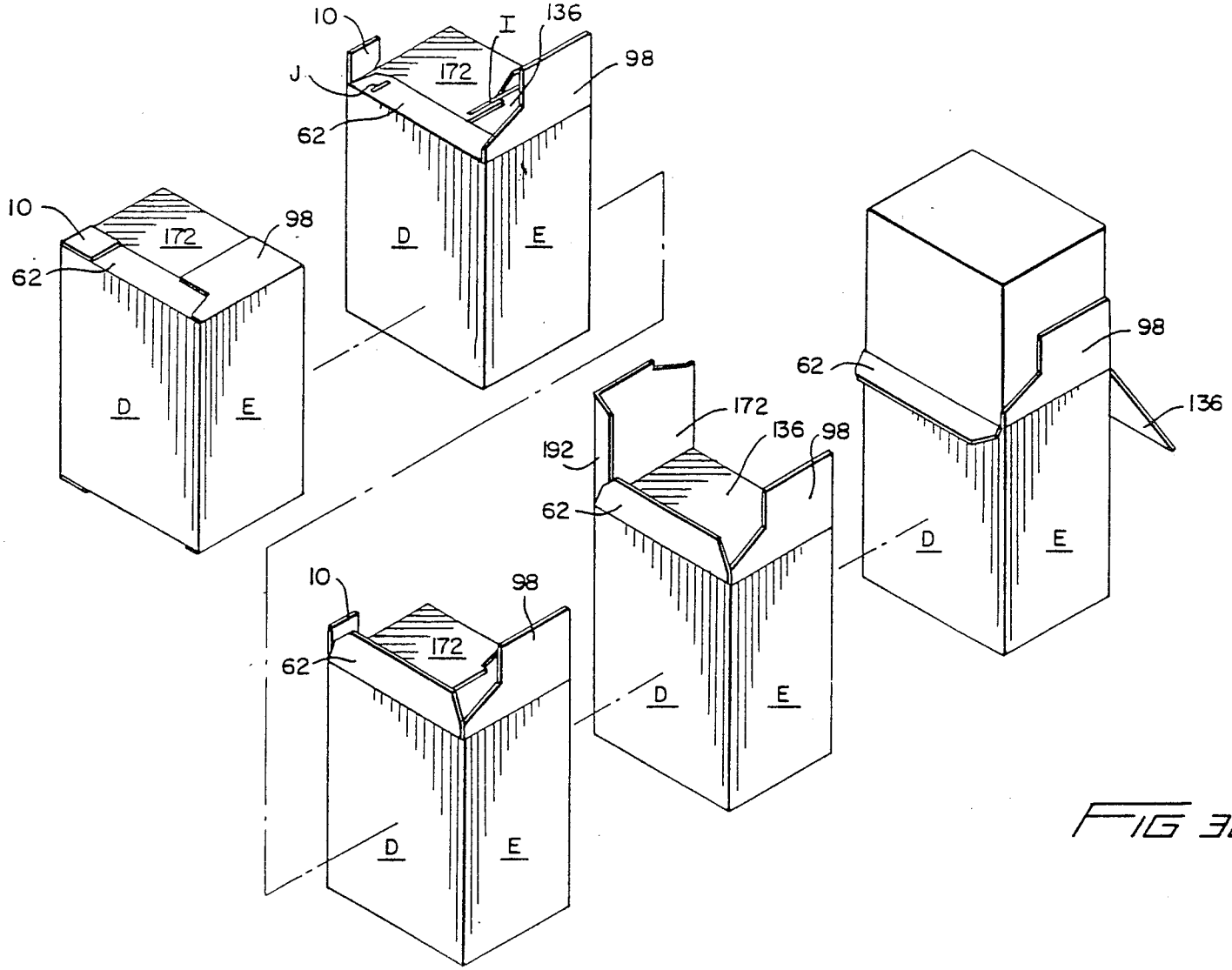

Referring to FIG. 3B, bottom panel end flap 136 and cover panel end flap 62 are folded outwardly to form a throat for receiving the contents of the carton. Subsequently, the carton K is filled with ice cream or similar type semi-liquid contents. Upon filling of the carton K, the force on bottom panel end flap 136 and cover panel end flap 62 is removed resulting in the end flaps moving to an upright position.

Front panel end flap 172 is folded inwardly such that front panel end flap membrane 192 engages cam surface 154 formed on bottom panel end flap 136 and is thereby biased upwardly into abutting contact with cover panel D. This feature of the present invention significantly enhances the seal of the carton end. Cover panel end flap 62 is subsequently folded inwardly to overlie front panel end flap 172 and bottom panel end flap 136 as best seen in FIG. 6. Adhesive strips I and J are applied to the upper carton end in an identical manner as applied to the lower carton end. Subsequently, rear panel end flap 98 is folded inwardly and secured to bottom panel end flap 136 and front panel end flap 172. Finally, cover tab 10 is folded inwardly and secured to cover panel end flap 62 via adhesive strip J. Thus the carton K is sealed as shown in FIG. 7.

Referring to FIG. 4, a prior art ice cream carton formed in accordance with U.S. Pat. No. 4,555,027 is depicted. As is readily seen from the drawing, a swell or rise of the contents of the carton occurs at the upper end upon completion of the filling operation. This will result in residue being formed on the cover panel end flap 62'. The end flaps of the prior art carton are folded inwardly in such a manner that the residue will remain on the cover panel end flap 62'.

Specifically, the rear panel end flap 98' is folded inwardly first followed by the front panel end flap 172'. Subsequently, the cover panel end flap 62' is folded inwardly followed by the bottom panel end flap 136'. As is readily evident from the folding steps of the prior art carton, the residue formed on the cover panel end flap 62' will seap out of the front and rear edges 74' and 76' once cover panel end flap 62' comes into contact with rear panel end flap 98' and front panel end flap 172'. This will result in an unsightly carton and may project an image of a damaged product. Thus, consumers will be very unlikely to purchase such a carton and the carton and its contents will ultimately be disguarded.

CARTON OPENING FIG. 8

Figure 8:
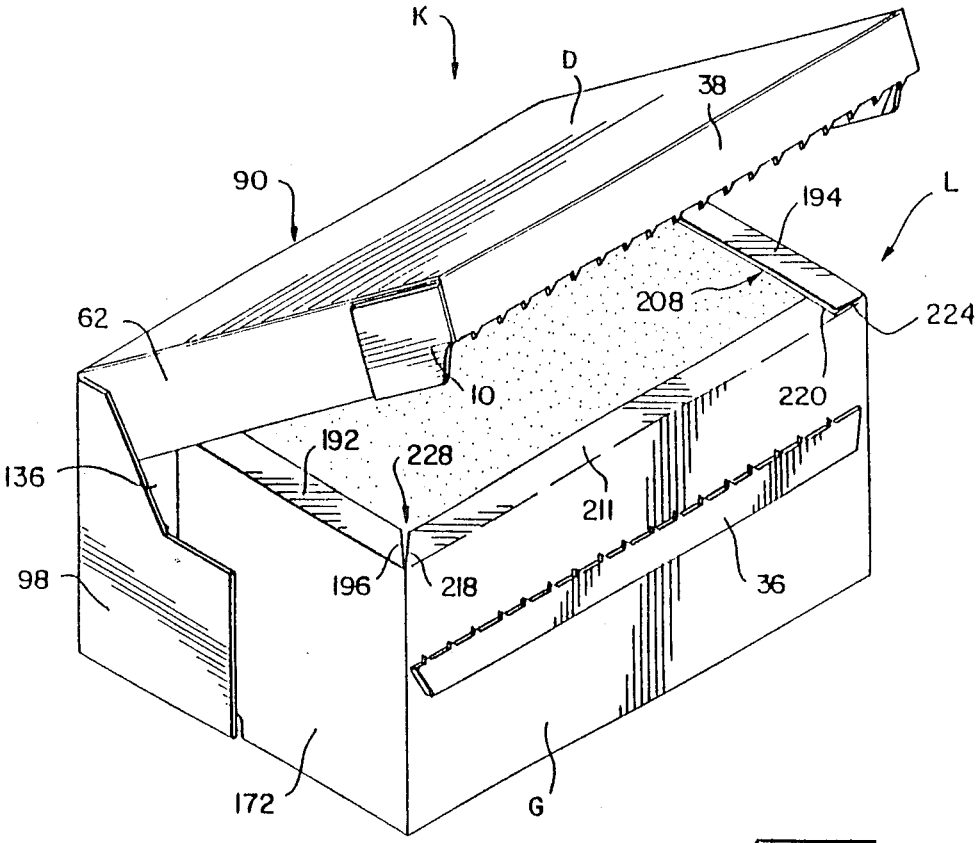
FIG. 8 is a perspective of the carton with the tear strip removed and the cover partially raised.

The steps necessary to obtain access to the contents of the carton K will now be explained with reference to FIG. 8. To detach the cover panel D from the front panel G, one need only pull on tear tab 50 and remove tear strip 30 from front panel F. This enables a consumer to bend the cover panel D backwards about hinge line 90 to gain access to the contents of the carton K.

The membrane flaps 192, 194 and 211 form a continuous lip L about a portion of the outer periphery of carton K. The lip L significantly enhances the seal of carton K. As seen in FIG. 8, the V-shaped notch 228 permits the front edge 196 of end flap membrane 192 to abut left end flap 218 of front panel membrane 211. The complementary 45° angles formed in front panel end flap membrane 192 and front panel membrane 211 provide lip L with a sealed left front corner. The rectangularly shaped notch 224 permits a portion of edge 208 of end flap membrane 194 to abut right edge 220 of front panel membrane 211 thereby forming a substantially sealed right front corner in lip L. The seal formed by the complementary 45° angles is preferable to that formed by the rectangular notch 224.

ALTERNATIVE EMBODIMENT FOR CARTON BLANK FIGS. 9 through 21

Figure 10:
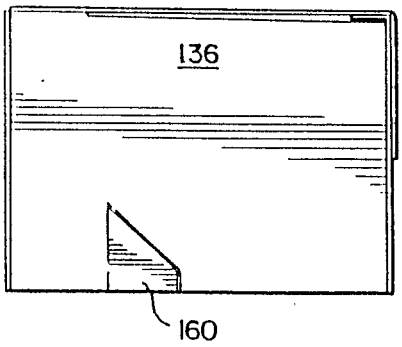
FIG. 10 is a side elevation view of the left end of the second embodiment of the carton with only the bottom panel end flap folded inwardly.
Figure 11:
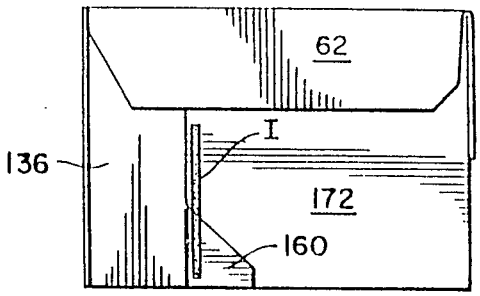
FIG. 11 is a side elevation view of the left end of the second embodiment of the carton depicting the end flaps folded inwardly with the exception of the rear panel end flap.
Figure 9:
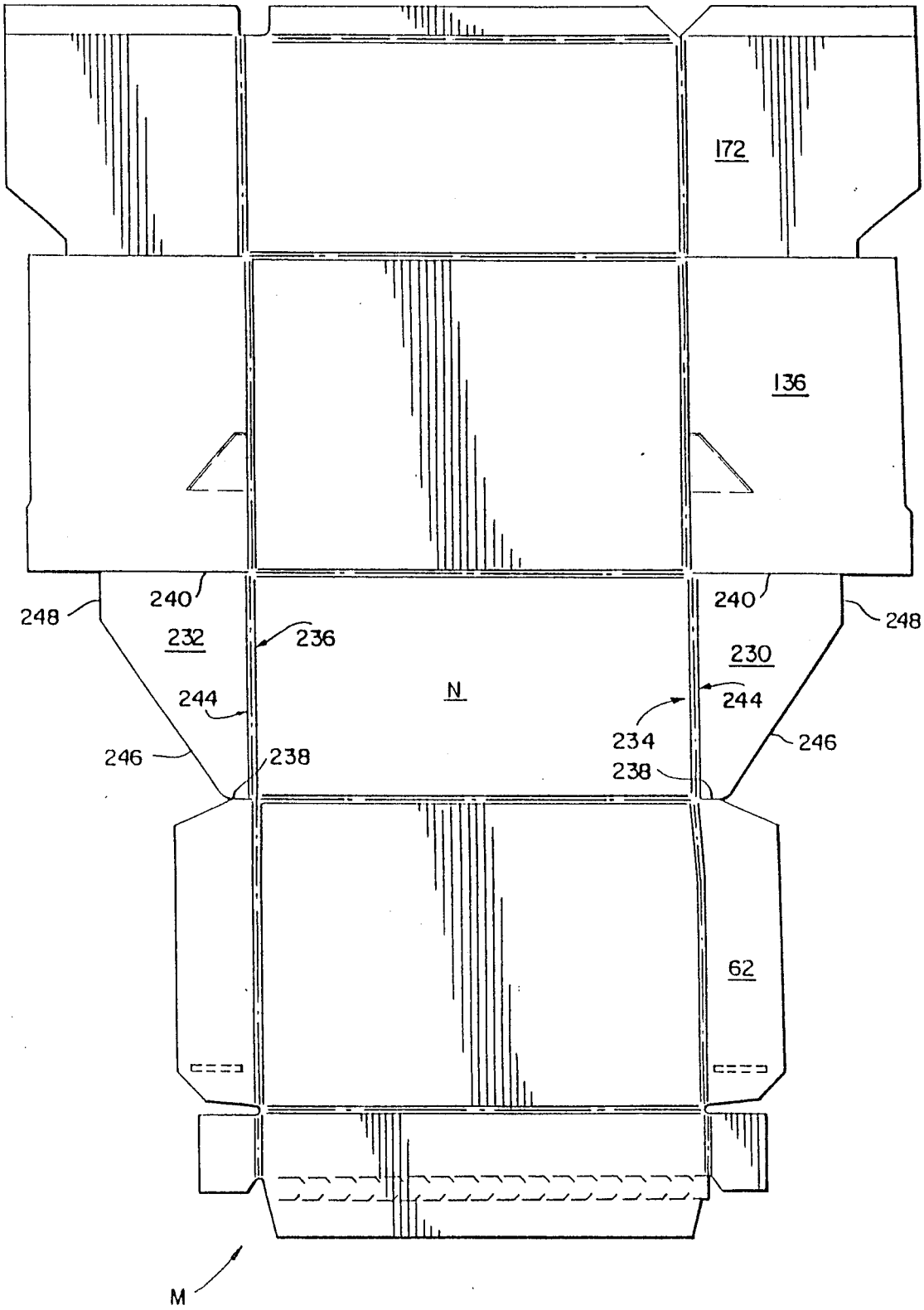
FIG. 9 is a plan view of the inner surface of a second embodiment of a flat carton blank formed in accordance with the present invention.
Figure 16:
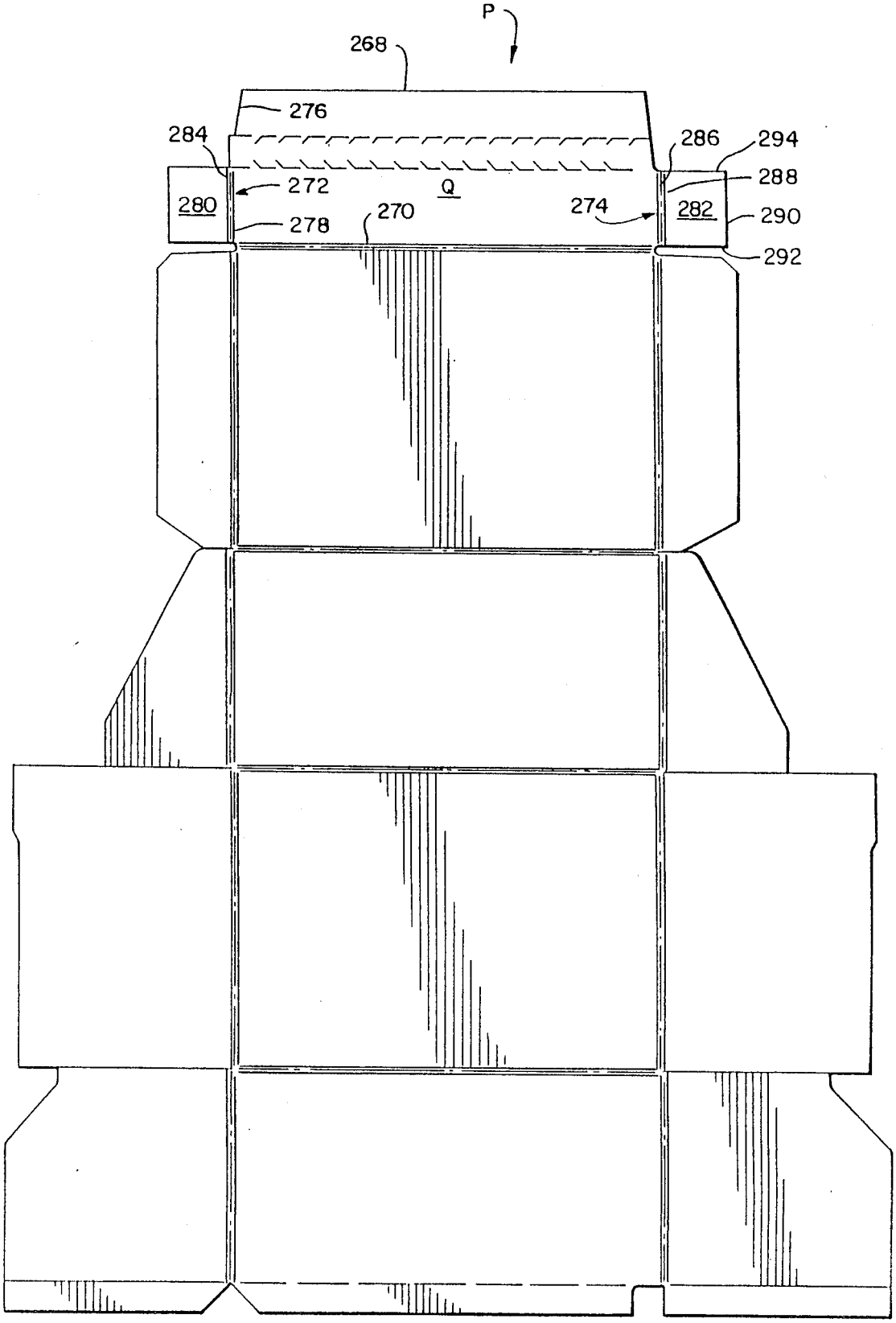
FIG. 16 is a plan view of the inner surface of the fourth embodiment of a flat carton blank formed in accordance with the present invention.

The second embodiment of the carton blank will be described with reference to FIGS. 9 through 12. Blank M, as best seen in FIG. 9, is similar to carton blank A and thus only the differences therebetween will be discussed. Rear panel end flaps 230 and 232 are hingedly connected to rear panel N at left and right edges 234 and 236 respectively. Rear panel end flaps 230 and 232 are defined by top edge 238, bottom edge 240, front edge 242 and rear edge 244. Front edge 242 includes first and second portions 246 and 248. First portion 246 extends from top edge 238 and forms an obtuse angle less than 180° therewith. Second portion 248 extends from first portion 242 and forms an obtuse angle less than 180° therewith. Second portion 248 further extends parallel to rear edge 244. This particular configuration of the rear panel end flaps, unlike the rear panel end flaps 98 and 100 of carton blank A, are compatible with presently known blanking appartii. Therefore, a manufacturer need not incur any additional expense in either modifying the current used blanking devices or in the development of a new blanking device. As is seen in FIGS. 10 through 12, the sequence of folding the end flaps is identical to that of carton blank A.

The third embodiment of the carton blank will be described with reference to FIGS. 13 through 15. Blank O is similar to blanks A and M, therefore, only the differences therebetween will be discussed. Further, since blank O is symmetrical only one side is shown in FIG. 13. Front end flap membrane 246 includes a beveled inner edge 248 for facilitating the assembly of the carton ends. Front panel end flap 250 includes a substantially rectangular shaped notch 252 formed in its rear edge 254. Rear end flap panels 256 include first, second and third offset portions 258, 260 and 262 respectively. Referring to FIG. 14, cut-out 252 is configured identically to third portion 262 and cooperates therewith so that offset third portion 262 is substantially planar with front panel end flap 250. Further, as best seen in FIG. 15, second portion 260 is substantially planar with cover panel end flap 264. This particular configuration of the rear panel end flap 256 insures that it will be securely fastened to bottom panel end flap 266 and front panel and flap 250.

The fourth embodiment of the carton blank formed in accordance with the present invention will be described with reference to FIGS. 16 through 19. Carton blank P is similar to carton blank A and M and, therefore, only the difference therebetween will be hereinafter discussed. Closure flap Q of carton blank P is defined by bottom edge 268, top edge 270, left edge 272, and right edge 274. Left and right edges 272 and 274 each include first and second portions 276 and 278. Cover tabs 280 and 282 are hingedly connected to second portions 278 of left and right edges 272 and 274 respectively forming hinge lines 284 and 286 therebetween. Cover or glue tabs 280 and 282 are defined by front edge 288, rear edge 290, top edge 292, and bottom edge 294. Front edges 288 extend the length of corresponding hinge lines 284 and 286. This particular arrangement eliminates the notch or recess formed intermediate bottom edges 294 of the cover tabs 280 and 282 and closure flap Q. By eliminating these notches, the cover tabs 280 and 282 are significantly strengthened.

Figure 17:
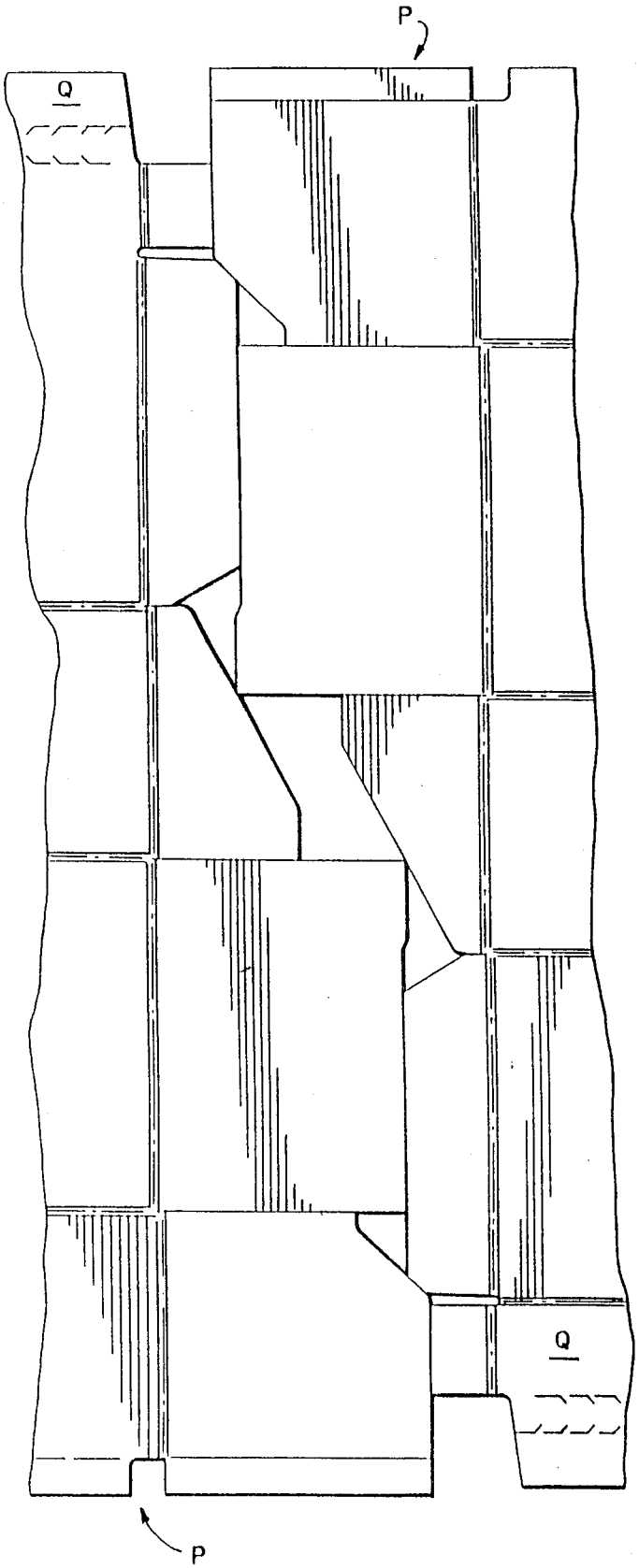
FIG. 17 is a fragmentary plan view of a pair of carton blanks, formed in accordance with the fourth embodiment of the present invention, illustrating their orientation during the blanking operation.
Figure 18:
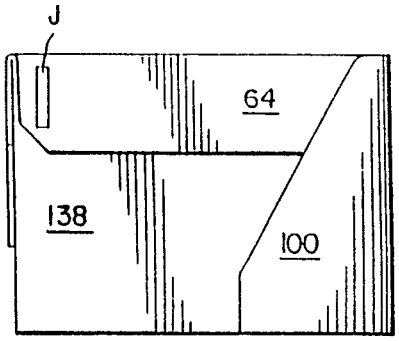
FIG. 18 is a side elevation view of the right end of the fourth embodiment of the carton depicting the end flaps folded inwardly with the exception of the (cover tab panel).
Figure 19:
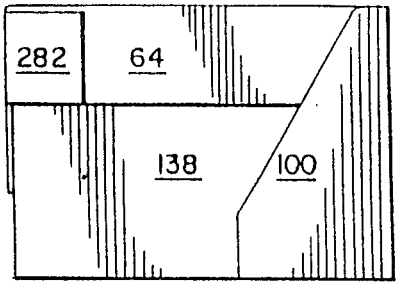
FIG. 19 is a side elevation view of a sealed end of the fourth embodiment of the carton depicting the right carton end sealed.

Referring to FIG. 17, a pair of carton blanks formed in accordance with the fourth embodiment of present invention are illustrated as oriented during the blanking operation. As is evident from the drawing, the end flaps have been designed to reduce the amount of scrap stock produced in the blanking operation, and to produce an efficient nesting layout.

Figure 20:
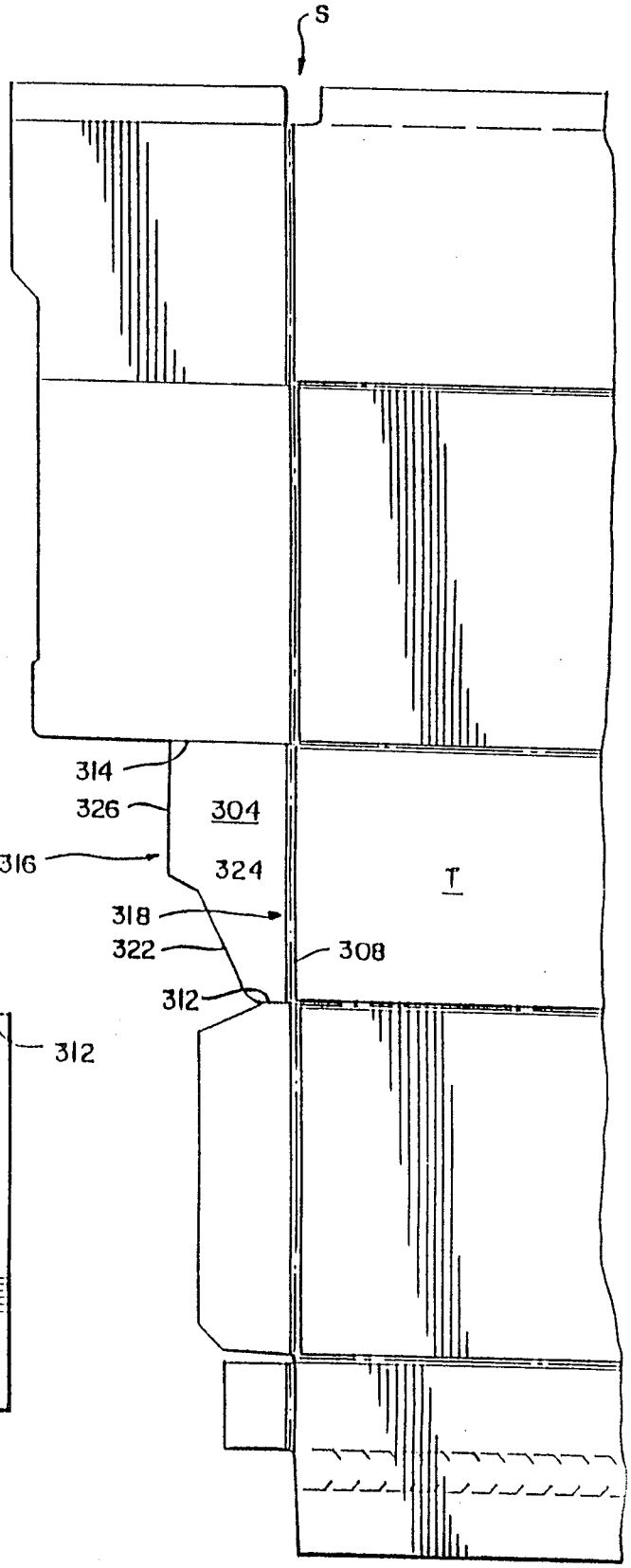
FIG. 20 is a partial fragmentary plan view of the inner surface of the fifth embodiment of a flat carton blank formed in accordance with the present invention.
Figure 21:
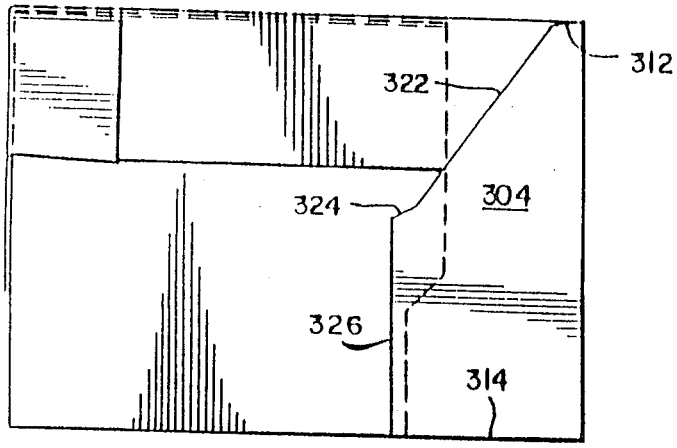
FIG. 21 is a side elevation view of a sealed end of the fifth embodiment of a carton blank.

The fifth and final embodiment of the carton blank formed in accordance with the present invention will be described with reference to FIGS. 20 and 21. Since carton blank S is symmetrical only a portion thereof will be shown. Carton blank S includes rear panel end flap 304 hingedly connected to rear panel T forming hinge line 308 therebetween. Rear panel end flap 304 is defined by top edge 312, bottom edge 314, front edge 316 and rear edge 318. Front edge 316 includes first, second, and third portions 322, 324 and 326 respectively. First portion 322 extends from top edge 312 and forms an obtuse angle of less than 180° therewith. Second portion 324 extends angularly from first portion 322 and forms an obtuse angle greater than 180° therewith. Third portion 326 extends from second portion 324 and forms an obtuse angle less than 180° therewith. Further, third portion 318 extends substantially parallel to the corresponding hinge line 308. The advantage of this particular design for rear panel end flap 304 is seen in FIG. 21 i.e. the formation of a substantially continuous end surface. Thus, the carton ends formed in accordance with the fifth embodiment of present invention readily accommodate printed matter and various illustrations associated with ice cream cartons informing the consumer of the type of ice cream contained therein as well as the brand name.

While this invention has been described as having a preferred design, it is understood that it is capable of further modification, uses and/or adaptations of the invention following in general the principle of the invention and including such departures from the present disclosure as come within known or customary practice in the art to which the invention pertains, such as may be applied to essential features set forth, and fall within the scope of the invention of the limits of the appended claims.

What is claimed is:

1. A carton for packaging ice cream or the like, comprising:

(a) a receptacle, including hingedly connected front, bottom and rear panels;

(b) said front panel and said rear panel each having top, bottom, left and right edges;

(c) said bottom panel having front, rear, left and right edges;

(d) said front panel being hingedly connected at its bottom edge to said front edge of said bottom panel;

(e) said bottom panel being hingedly connected at its rear edge to said bottom edge of said rear panel;

(f) a cover including a cover panel having front, rear, left and right edges;

(g) said cover panel being hingedly connected at its rear edge to said top edge of said rear panel of said receptacle;

(h) said cover further including a closure flap hingedly connected to said front edge of said cover panel;

(i) means for securing said closure flap to said front panel;

(j) said panels of said receptacle and said cover each having left and right end flaps connected to said left and right edges respectively forming hinge lines therebetween;

(k) said left end flaps of said receptacle and said cover being dimensioned to form a substantially sealed left end of said carton;

(l) said right end flaps of said receptacle and said cover being dimensioned to form a substantially sealed right end of said carton;

(m) said front panel having a membrane flap extending from the top edge of said front panel;

(n) said left and right front panel end flaps each having a membrane flap extending from said top edges;

(o) said left and right front panel end flap membranes and said front panel membrane forming a substantially continuous lip extending inwardly and along at least a portion of the outer periphery of said receptacle;

(p) pocket means for receiving a portion of said cover panel end flaps adjacent said rear panel for reforming said carton subsequent to initial removal of said closure flap from said front panel;

(q) said pocket means including rear panel end flaps forming an exterior portion of said pocket means operably associated with at least one of said front panel and bottom panel flaps of said receptacle forming an interior portion of said pocket means;

(r) said bottom panel end flaps include first and second portions;

(s) said front panel end flaps each include a cut-out formed adjacent said hinge line formed intermediate said bottom panel and the corresponding bottom panel end flap; and (t) said second portion of said bottom panel end flap is offset from said first portion and operably associated with said corresponding front panel end flaps adjacent said cut-out for providing said second portion substantially planar with at least a portion of said corresponding front panel end flap.

2. A carton as in claim 1, wherein:

(a) said pocket means includes means for securing at least a portion of one of said rear panel end flaps to at least the corresponding bottom panel end flap adjacent the hinge line formed intermediate said bottom panel and said corresponding bottom panel end flap.

3. A carton as in claim 1, wherein:

(a) said pocket means includes means for securing at least a portion of said rear panel end flaps to the corresponding bottom panel end flap and the corresponding front panel end flap; and (b) at least a portion of said bottom panel end flaps and said front panel end flaps form said interior portion of said pocket means.

4. A carton as in claim 1, wherein:

(a) said hinge lines formed intermediate said cover panel and said cover panel end flaps include a tapered segment adjacent said rear panel.

5. A carton as in claim 1, wherein:

(a) said front panel and said front panel membrane have a hinge line formed therebetween; and (b) said hinge line includes a plurality of slits formed therein and extending therethrough.

6. A carton as in claim 1, wherein:

(a) said closure flap includes top, bottom, left and right edges;

(b) said left and right edges each having a cover tab extending therefrom; and (c) means for securing said cover tabs to the corresponding cover panel end flaps.

7. A carton for packaging ice cream or the like, comprising:

(a) a receptacle, including hingedly connected front, bottom and rear panels;

(b) said front panel and said rear panel each having top, bottom, left and right edges;

(c) said bottom panel having front, rear, left and right edges;

(d) said front panel being hingedly connected at its bottom edge to said front edge of said bottom panel;

(e) said bottom panel being hingedly connected at its rear edge to said bottom edge of said rear panel;

(f) a cover including a cover panel having front, rear, left and right edges;

(g) said cover panel being hingedly connected at its rear edge to said top edge of said rear panel of said receptacle;

(h) said cover further including a closure flap hingedly connected to said front edge of said cover panel;

(i) means for securing said closure flap to said front panel;

(j) said panels of said receptacle and said cover each having left and right end flaps connected to said left and right edges respectively forming hinge lines therebetween;

(k) said left end flaps of said receptacle and said cover being dimensioned to form a substantially sealed left end of said carton;

(l) said right end flaps of said receptacle and said covering being dimensioned to form a substantially sealed right end of said carton;

(m) said front panel having a membrane flap extending from the top edge of said front panel;

(n) said left and right front panel end flaps each having a membrane flap extending from said top edges;

(o) said left and right front panel end flap membranes and said front panel membrane forming a substantially continuous lip extending inwardly and along at least a portion of the outer periphery of said receptacle;

(p) pocket means for receiving a portion of said cover panel end flaps adjacent said rear panel for reforming said carton subsequent to initial removal of said closure flap from said front panel;

(q) said pocket means including rear panel end flaps forming an exterior portion of said pocket means operably associated with at least one of said front panel and bottom panel flaps of said receptacle forming an interior portion of said pocket means;

(r) said rear panel end flaps include first, second and third portions;

(s) said second portion is offset from said first portion and said third portion is offset from said first and second portions;

(t) said second portion is operably associated with the corresponding cover panel end flaps for providing said second portion substantially planar with said corresponding cover panel end flap;

(u) said front panel end flaps each include a cut-out formed adjacent said hinge line formed intermediate said bottom panel and the corresponding bottom panel end flap; and (v) said third portion is operably associated with the corresponding front panel end flap adjacent said cut-out for providing said third portion substantially planar with at least a portion of the corresponding front panel end flap.

8. A carton as in claim 7, wherein:

(a) said pocket means includes means for securing said third portion to said bottom panel end flap and said second portion to said front panel end flap; and (b) said securing means consists solely of a single adhesive strip.

9. A carton for packaging ice cream and the like, comprising:

(a) a receptacle, including operably connected front, bottom, and rear panels, said front panel and said rear panel each having top, bottom, left and right edges, said bottom panel having front, rear, left and right edges, said front panel being operably connected at its bottom edge to said front edge of said bottom panel, said bottom panel being operably connected at its rear edge to said bottom edge of said rear panel;

(b) a cover including a cover panel having front, rear, left and right edges, said cover further including a closure flap hingedly connected to said front edge of said cover panel, said cover panel being operably connected at its rear edge to said top edge of said rear panel;

(c) means for securing said closure flap to said front panel;

(d) said panels each having left and right end flaps connected to said left and right edges, respectively, forming hinge lines therebetween;

(e) said left and right front panel end flaps each having top edges and a membrane flap extending from each of said top edges, said front panel having a membrane flap extending from said top edge of said front panel, said left and right front panel membranes and said front panel membrane forming a substantially continuous lip extending inwardly and along and at least a portion of the outer periphery of said receptacle;

(f) said end flaps having dimensions to form a substantially sealed right and left ends of said carton;

(g) said left right bottom panel end flaps foldable in first for forming the interior wall of the carton;

(h) said left and right front panel end flaps being foldable in second such that said front panel end flaps overlap only a portion of the corresponding bottom panel end flap, said left and right cover panel end flaps being foldable in third to form at least a portion of the exterior walls of the carton, said cover panel end flaps overlapping only a portion of the corresponding front and bottom panel end flaps, thereby defining an exposed area in each of said bottom panel end flaps not overlapped by said front and cover panel end flaps;

(i) said left and right bottom panel end flaps each having an embossed portion, at least a portion of said embossed portion being disposed within said exposed area;

(j) said left and right rear panel end flaps being foldable in fourth to form at least a portion of the exterior wall of the carton, said rear panel end flaps overlapping a portion of the corresponding bottom, front and cover panel end flaps, said rear panel end flap each having a lower portion overlapping said at least portion of said embossed portion, whereby said rear panel end flaps may be secured to the corresponding said at least a portion of said embossed portion; and (k) said left and right bottom panel end flaps include a cam means for biasing said front panel end flap membranes toward said cover panel upon folding of the corresponding front panel end flaps inwardly to form the carton ends.

10. A carton, as in claim 9, wherein:

(a) said closure flap includes at least one weakness line formed therein for permitting detachment of said cover panel from said front panel.

11. A carton, as in claim 10, wherein:

(a) said closure flap includes top, bottom, left and right edges;

(b) said left and right edges each having a cover tab extending therefrom; and (c) means for securing said cover tabs to the corresponding cover panel end flaps.

12. A blank for packaging ice cream or the like, comprising:

(a) connected cover, front, bottom and rear panels;

(b) said cover and bottom panels each having front, rear, left and right edges;

(c) said front and rear panels each having top, bottom, left and right edges;

(d) said cover panel having a closure flap hingedly connected to its front edge;

(e) said rear panel being hingedly connected at its top edge to said rear edge of said cover panel;

(f) said bottom panel being hingedly connected at its rear edge to said bottom edge of said rear panel;

(g) said front panel being hingedly connected at its bottom edge to said front edge of said bottom panel;

(h) said panels each having left and right end flaps connected to said left and right edges respectively forming hinge lines therebetween;

(i) said left end flaps being dimensioned such that upon folding of said end flaps inward, to form the left end of the carton, the left end is substantially sealed for preventing leakage therefrom;

(j) said right end flaps being dimensioned such that upon folding of said right end flaps inward, to form the right end of the carton, the right end is substantially sealed preventing leakage therefrom;

(k) said front panel having a membrane flap extending from its top edge;

(l) said front panel end flaps each having top, bottom, front and rear edges;

(m) said front panel end flaps each having a membrane flap extending from said top edges in a direction substantially similar to the direction said front panel membrane flap extends in the non-erected position;

(n) said left and right front panel end flap membranes each having a front, rear, inner and outer edges;

(o) said front panel membrane having rear, front, left side and right side edges;

(p) said left and right front panel end flap membranes said front panel membrane, when said blank is erected, forming a substantially continuous lip extending inwardly and along at least a portion of an outer periphery of the carton;

(q) at least one of said front panel end flap membranes having a front edge extending substantially parallel and substantially aligned with the corresponding hing line formed intermediate said left and right front panel end flaps and said front panel;

(r) said front panel membrane having its side edge, adjacent said front edge of said at least one of said front panel end flaps, spaced therefrom forming a first notch therebetween;

(s) said first notch extending along said hinge line formed between said front panel membrane and said front panel a distance substantially equal to the length of said front edge of said at least one of said front panel end flap membranes;

(t) said front panel membrane having its other side edge extending inwardly from the corresponding hinge line intermediate said front panel and said front panel end flap adjacent said other side edge and forming an obtuse angle less than 180° therewith; and (u) said inner edge of said front panel end flap membrane adjacent said other side edge extending outwardly from the corresponding hinge line intermediate said front panel and said front panel end flap adjacent said other side edge and forming an obtuse angle less than 180° therewith thereby forming a second notch between said front panel membrane and said front panel end flap membrane adjacent said other side edge.

13. A blank as in claim 12, wherein:

(a) said first notch is substantially rectangular in shape.

14. A blank as in claim 13, wherein:

(a) said other side edge forms an angle of about 135° with the corresponding hinge line intermediate said front panel and said front panel end flap adjacent said other side edge; and (b) said inner edge of said front panel end flap membrane adjacent said other side edge forms an angle of about 135° with the corresponding hinge line intermediate said front panel and said front panel end flap adjacent said other side edge.

15. A blank as in claim 12, wherein:

(a) said other side edge forms an angle of about 120° with the corresponding hinge line intermediate said front panel and said front panel end flap adjacent said other side edge; and (b) said inner side of said front panel end flap membrane adjacent said other side edge forms a angle of about 150° with the corresponding hinge line intermediate said front panel end flap adjacent said other side edge.

16. A blank as in claim 12, wherein:

(a) a hinge line is formed intermediate said front panel and said front panel membrane flap; and (b) said hinge line having a plurality of slits formed therein and extending therethrough.

17. A blank as in claim 12, wherein:

(a) said second notch being substantially V-shaped.

18. A blank as in claim 12, wherein:

(a) said hinge lines formed intermediate said front panel and said left front panel end flaps, said rear panel and said left rear panel end flaps, and said cover panel and said cover panel end flap each include at least a first segment;

(b) said hinge line formed intermediate said bottom panel and said left bottom panel end flap includes at least a first segment;

(c) said first segments of said hinge lines formed intermediate said front, rear and cover panels and the corresponding left panel end flaps are substantially aligned; and (d) said first segment of said hinge line formed intermediate said bottom panel and said left bottom panel end flap is offset from said first segments of said hinge lines formed intermediate said front, rear and cover panels and the corresponding left panel end flaps.

19. A blank as in claim 18, wherein:

(a) said hinge lines formed intermediate said front panel and said right front panel end flaps, said rear panel and said right rear panel end flap, and said cover panel and said right cover panel end flap each include at least a first segment;

(b) said hinge line formed intermediate said bottom panel and said right bottom panel end flap includes at least a first segment;

(c) said first segments of said hinge lines formed intermediate said front, rear and cover panels and the corresponding right panel end flaps are substantially aligned; and (d) said first segment of said hinge formed intermediate said bottom panel and said right bottom panel end flap is offset from said first segments of said hinge lines formed intermediate said front, rear and cover panels and the corresponding right panel end flaps.

20. A blank as in claim 19, wherein:

(a) said hinge lines formed intermediate said cover panel and said left and right cover panel end flaps each include a second segment; and (b) said second segments are tapered inwardly adjacent said rear panel.

21. A blank for forming a carton for packaging ice cream or the like, comprising:

(a) connected cover, front, bottom and rear panels, said cover and bottom panels each having front, rear, left and right edges, said front panels each having top, bottom, left and right edges;

(b) said rear panel being hingedly connected at its top edge to said rear edge of said cover panel, said bottom panel being hingedly connected at its rear edge to said bottom edge of said rear panel, said front panel being hingedly connected at its bottom edge to said front edge of said bottom panel;

(c) said cover panel having a closure flap hingedly connected to said cover panel front edge;

(d) said panels each having left and right end flaps connected to said left and right edges respectively, forming hinge lines therebetween, said left end flaps being dimensioned such that upon folding of said left end flaps inwardly to form the left end of the carton, the left end is substantially sealed for prevention leakage therefrom, and said right end flaps being dimensioned such that upon folding of said right end flaps inwardly, to form the right end of the carton, the right end is substantially sealed for prevention leakage therefrom;

(e) said front panel having a membrane flap extending from the top edge of said front panel, said left and right front panel end flaps each having top edges and a membrane flap extending from said each of top edges, and said left and right front panel end flap membranes and said front panel membrane forming a substantially continuous lip extending inwardly and along at least a portion of an outer periphery of the carton;

(f) said end flaps each having top, bottom, front and rear edges;

(g) said left and right bottom panel end flaps foldable in first for thereby forming the interior wall of the carton, said left and right front panel end flaps foldable in second such that said front panel end flaps overlap only a portion of the corresponding bottom end flaps, said left and right cover panel end flaps foldable in third such that said cover panel end flaps overlap only a portion of the corresponding bottom and front panel end flaps, whereby an exposed area in each of said bottom panel end flaps in non-overlapping with respect to said front and cover panel end flaps;

(h) said bottom panel end flaps each including an embossed portion, at least a portion of said embossed portion being disposed within said exposed area;

(i) said left and right rear panel end flaps foldable in fourth for forming at least a portion of the exterior wall of the carton, said rear panel end flaps overlapping a portion of the corresponding bottom, front and cover panel end flaps, said rear panel end flaps having a lower portion overlapping said at least portion of said embossed portion, whereby said rear panel end flaps may be secured to the corresponding said at least portion of said embossed portion; and (j) said left and right bottom panel end flaps include cam means for biasing said front panel end flap membranes towards said cover panel upon folding of the corresponding front panel end flaps inwardly to form the carton ends from said blank.

22. A carton for packaging ice cream and the like, comprising:

(a) a receptacle, including operably connected front, bottom, and rear panels, said front panel and said rear panel each having top, bottom, left and right edges, said bottom panel having front, rear, left and right edges, said front panel being operably connected at its bottom edge to said front edge of said bottom panel, said bottom panel being operably connected at its rear edge to said bottom edge of said rear panel;

(b) a cover including a cover panel having front, rear, left and right edges, said cover further including a closure flap hingedly connected to said front edge of said cover panel, said cover panel being operably connected at its rear edge to said top edge of said rear panel;

(c) means for securing said closure flap to said front panel;

(d) said panels each having left and right end flaps connected to said left and right edges, respectively, forming hinge lines therebetween;

(e) said left and right front panel end flaps each having top edges and a membrane flap extending from each of said top edges, said front panel having a membrane flap extending from said top edge of said front panel, said left and right front panel membranes and said front panel membrane forming a substantially continuous lip extending inwardly and along at least a portion of the outer periphery of said receptacle; .

(f) said end flaps having dimensions to form a substantially sealed right and left ends of said carton;

(g) said left right bottom panel end flaps being foldable in first for forming the interior wall of the carton;

(h) said left and right front panel end flaps being foldable in second such that said front panel end flaps overlap only a portion of the corresponding bottom panel end flap, said left and right cover panel end flaps being foldable in third to form at least a portion of the exterior walls of the carton, said cover panel end flaps overlapping only a portion of the corresponding front and bottom panel end flaps, thereby defining an exposed area in each of said bottom panel end flaps not overlapped by said front an cover panel end flaps;

(i) said left and right bottom panel end flaps each having an embossed portion, at least a portion of said embossed portion being disposed within said exposed area;

(j) said left and right rear panel end flaps being foldable in fourth to form at least a portion of the exterior wall of the carton, said rear panel end flaps overlapping a portion of the corresponding bottom, front and cover panel end flaps, said rear panel end flap each having a lower portion overlapping said at least portion of said embossed portion, whereby said rear panel end flaps may be secured to the corresponding said at least a portion of said embossed portion;

(k) said front panel end flaps each including a cut-out formed adjacent said hinge line formed intermediate said bottom panel and the corresponding bottom panel end flap; and (l) said embossed portion being operably associated with said corresponding front panel end flap adjacent said cut-out for providing said embossed portion substantially planar with at least a portion of said corresponding front panel end flap.

23. A carton as in claim 22, wherein:

(a) said bottom, front, cover and rear panel end flaps include top, rear, bottom and front edges; and (b) said exposed area in each of said bottom panel end flaps is bounded by at least a portion of said rear edge of the respective front panel end flap, at least a portion of said bottom and rear edges of the respective cover panel end flap, and at least a portion of said rear and bottom edges of the respective bottom panel end flap.

24. A carton as in claim 23, wherein:

(a) said rear edges of said front panel end flaps include first, second and third sections;

(b) said first and third sections are substantially parallel to each other and said second section intersects said first and third sections at an angle;

(c) said first and second sections make a first interior angle; and (d) said second and third sections make a second interior angle.

25. A carton as in claim 24, wherein:

(a) said first and second interior angles are obtuse.

26. A carton as in claim 25, wherein:

(a) said first and third sections are substantially parallel to said rear edge of the respective bottom panel end flap.

27. A carton as in claim 26, wherein:

(a) the distance between said first section and said rear edge of the respective bottom panel end flap is greater than the distance between said third section and said rear edge of the respective bottom panel end flap.

28. A carton as in claim 21, wherein:

(a) the distance between said first section and said rear edge of the respective bottom panel end flap is less than ½ the distance between said front edge and rear edges of the respective bottom panel end flap.

29. A carton as in claim 23, wherein:

(a) said rear and bottom edges of said cover panel end flaps intersect at an obtuse angle.

30. A carton as in claim 23, wherein:

(a) said embossed portion includes a front edge spaced from said rear edge of the respective front panel end flap.

31. A carton as in claim 23, wherein:

(a) said embossed portion includes a top edge spaced from said bottom edge of the respective cover panel end flap.

32. A carton as in claim 23, wherein:

(a) said embossed portion includes a rear edge spaced from said rear edge of the respective bottom panel end flap.

33. A carton as in claim 23, wherein:

(a) said front edges of said rear panel end flaps include a lower edge portion, said lower edge portion overlaps at least a portion of said front panel end flaps.

34. A carton as in claim 33, wherein:

(a) said lower edge portion is substantially parallel to said first and third sections of said rear edge of the respective front panel end flap.

35. A carton as in claim 34, wherein:

(a) said lower edge portion of said rear panel end flap front edge intersects at an angle with an adjacent upper edge portion.

36. A carton as in claim 35, wherein:

(a) said rear panel end flaps each includes an upper portion; and (b) said lower portion of said rear panel end flaps is wider than said upper portion.

37. A carton as in claim 23, wherein:

(a) a substantial portion of said embossed portion in each of said bottom panel end flaps is spaced from said edges of said bottom, front and cover panel end flaps.

38. A carton, as in claim 22, and further comprising:

(a) pocket means for receiving a portion of said cover panel end flaps adjacent said rear panel for reforming said carton subsequent to initial removal of said closure flap from said front panel; and (b) said pocket means including said rear panel end flaps forming an exterior portion of said pocket means operably associated with at least one of said front panel and bottom panel end flaps other end flap of said receptacle forming an interior portion of said pocket means.

39. A blank for forming a carton for packaging ice cream or the like, comprising;

(a) connected cover, front, bottom and rear panels, said cover and bottom panels each having front, rear, left and right edges, said front panels each having top, bottom, left and right edges;

(b) said rear panel being hingedly connected at its top edge to said rear edge of said cover panel, said bottom panel being hingedly connected at its rear edge to said bottom edge of said rear panel, said front panel being hingedly connected at its bottom edge to said front panel being hingedly connected at its bottom edge to said front edge of said bottom panel;

(c) said cover panel having a closure flap hingedly connected to said cover panel front edge;

(d) said panels each having left and right end flaps connected to said left and right edges respectively, forming hinge lines therebetween, said left end flaps being dimensioned such that upon folding of said left end flaps inwardly to form the left end of the carton, the left end is substantially sealed for preventing leakage therefrom, and said right end flaps being dimensioned such that upon folding of said right end flaps inwardly, to form the right end of the carton, the right end is substantially sealed for preventing leakage therefrom;

(e) said front panel having a membrane flap extending from the top edge of said front panel, said left and right front panel end flaps each having top edges and a membrane flap extending from said each of top edges, and said left and right front panel end flap membranes and said front panel membrane forming a substantially continuous lip extending inwardly and along at least a portion of an outer periphery of the carton;

(f) said end flaps each having top, bottom, front and rear edges;

(g) said left and right bottom panel end flaps foldable in first for thereby forming the interior wall of the carton, said left and right front panel end flaps foldable in second such that said front panel end flaps overlap only a portion of the corresponding bottom end flaps, said left and right cover panel end flaps foldable in third such that said cover panel end flaps overlap only a portion of the corresponding bottom and front panel end flaps, whereby an exposed area in each of said bottom panel end flaps is non-overlapping with respect to said front and cover panel end flaps;

(h) said bottom panel end flaps each including an embossed portion, at least a portion of said embossed portion being disposed within said exposed area;

(i) said left and right rear panel end flaps foldable in fourth for forming at least a portion of the exterior wall of the carton, said rear panel end flaps overlapping a portion of the corresponding bottom, front and cover panel end flaps, said rear panel end flaps having a lower portion overlapping said at least portion of said embossed portion, whereby said rear panel end flaps may be secured to the corresponding said at least portion of said embossed portion;

(j) said bottom panel end flaps include first and second portions;

(k) said front panel end flaps each include a cut-out formed adjacent said hinge line formed intermediate said bottom panel and the corresponding bottom panel end flap; and (l) said second portion of said bottom panel end flaps is offset from said first portion and operably associated with said corresponding front panel end flaps adjacent said cut-out for providing said second portion substantially planar with at least a portion of said corresponding front panel end flap.

40. A blank as in claim 39, wherein:

(a) said exposed area in each of said bottom panel end flaps is bounded by at least a portion of said rear edge of the respective front panel end flap, at least a portion of said bottom and rear edges of the respective cover panel end flap, and at least a portion of said rear and bottom edges of the respective bottom panel end flap.

41. A blank as in claim 40, wherein:

(a) said rear edges of said front panel end flaps include first, second and third sections;

(b) said first and third sections are substantially parallel to each other and said second section intersects said first and third sections at an angle;

(c) said first and second sections make a first interior angle; and (d) said second and third sections make a second interior angle.

42. A blank as in claim 41, wherein:

(a) said first and second interior angles are obtuse.

43. A blank as in claim 42, wherein:

(a) said first and third sections are substantially parallel to said rear edge of the respective bottom panel end flap.

44. A blank as in claim 43, wherein:

(a) the distance between said first section and said rear edge of the respective bottom panel end flap is greater than the distance between said third section and said rear edge of the respective bottom panel end flap.

45. A blank as in claim 44, wherein:

(a) the distance between said first section and said rear edge of the respective bottom panel end flap is less than ½ the distance between said front edge and rear edges of the respective bottom panel end flap.

46. A blank as in claim 40, wherein:

(a) said rear and bottom edges of said cover panel end flaps intersect at an obtuse angle.

47. A blank as in claim 40, wherein:

(a) said embossed portion includes a front edge spaced from said rear edge of the respective front panel end flap.

48. A blank as in claim 40, wherein:

(a) said embossed portion includes a top edge spaced from said bottom edge of the respective cover panel end flap.

49. A blank as in claim 40, wherein:

(a) said embossed portion includes a rear edge spaced from said rear edge of the respective bottom panel end flap.

50. A blank as in claim 40, wherein:

(a) said front edges of said rear panel end flaps include a lower edge portion, said lower edge portion overlaps at least a portion of said front panel end flaps.

51. A blank as in claim 50, wherein:

(a) said lower edge portion is substantially parallel to said first and third sections of said rear edge of the respective front panel end flap.

52. A blank as in claim 51, wherein:

(a) said lower edge portion of said rear panel end flap front edge intersects at an angle with an adjacent upper edge portion.

53. A blank as in claim 52, wherein:

(a) said rear panel end flaps each includes an upper portion; and (b) said lower portion of said rear panel end flaps is wider than said upper portion.

54. A blank as in claim 40, wherein:

(a) a substantial portion of said embossed portion in each of said bottom panel end flaps is spaced from said edges of said bottom, front and cover panel end flaps.

55. A blank as in claim 39 and further comprising:

(a) pocket means when said blank is formed into a carton for receiving a portion of said cover panel end flaps adjacent said rear panel for reforming said carton subsequent to initial removal of said closure flap from said front panel; and (b) said pocket means including said rear panel end flaps forming an exterior portion of said pocket means operably associated with at least one of said front panel and bottom panel flaps of said carton forming an interior portion of said pocket means.

56. A blank as in claim 39, wherein:

(a) said closure flap having at least one weakness line formed therein for permitting detachment of said cover panel from said front panel when said blank is fully erected into a carton.

57. A blank as in claim 56, wherein:

(a) said closure flap includes top, bottom, left and right edges;

(b) said left and right edges each having a cover tab extending therefrom; and (c) means for securing said cover tabs to the corresponding cover panel end flaps.

58. A method for folding a blank for forming a carton for packaging ice cream or the like in which said blank includes hingedly connected closure flap, cover panel, front panel, bottom panel and rear panel, and each of said panels having hingedly connected left and right end flaps and a membrane flap extending from each of the left and right front panel end flaps and the front panel, the steps for forming the carton include:

(a) folding said front panel so that it overlies at least a portion of said bottom panel;

(b) folding said cover panel and said closure flap such that said cover panel overlies at least said rear panel and said closure flap overlies at least a portion of said front panel membrane and said front panel;

(c) securing said closure flap to said front panel;

(d) erecting said front, bottom, cover and rear panels in a substantially vertical plane forming a substantially rectangular body having an upper and lower end, said body being formed such that said end flaps extend substantially in the same plane as the corresponding panels and said left and right end flap membranes and said front panel membrane extend perpendicular to the respective front panel end flaps and front panel;

(e) folding inwardly said bottom panel end flap of said lower end of said body so that it is substantially perpendicular with said bottom panel, (f) folding inwardly said front panel end flap of said lower end so that it is substantially perpendicular to said front panel;

(g) folding inwardly said cover panel end flap of said lower end so that it is substantially perpendicular with said rear panel;

(h) folding said rear panel end flap of said lower end inwardly so that it is substantially perpendicular with said rear panel;

(i) securing said rear panel end flap of said lower end to at least one of the other lower end flaps and forming a pocket receiving at least a portion of said lower cover panel end flap adjacent said rear panel;

(j) biasing said end flaps of said upper end of said body outwardly;

(k) filling said body with ice cream or the like;

(l) folding said bottom panel end flap of the upper end of said body so that said bottom panel end flap removes any ice cream on said cover panel end flap of said upper end and said bottom panel end flap is perpendicular with said bottom panel;

(m) folding said front panel end flap inwardly so that it is perpendicular to said front panel;

(n) folding said cover panel end flap of said upper end inwardly so that it is perpendicular to said cover panel;

(o) folding said rear panel end flap inwardly so that it is perpendicular to said rear panel; and (p) securing said rear panel end flap of said upper end to at least one of the other upper end flaps and forming a pocket receiving at least a portion of said upper cover panel adjacent said rear panel.

59. A method as in claim 58, wherein the step of securing said rear panel end flaps includes the steps of:

(a) applying a single strip of adhesive vertically along a portion of at least said bottom panel end flaps; and (b) securing said rear panel end flaps to a portion of at least the corresponding bottom panel end flap.

60. A method as in claim 58, wherein the step of securing said rear panel includes the steps of:

(a) applying a single strip of adhesive vertically along a portion of said bottom panel end flaps and at least a portion of said front panel end flaps; and (b) securing said rear panel end flaps to a portion of said bottom panel end flaps and said front panel end flaps.

61. A method as in claim 58, wherein the step of folding said front panel end steps includes the step of:

(a) biasing the front panel end flap membranes upwardly into abutting contact with said cover panel.

62. A method for erecting a folded blank and forming a carton for packaging ice cream or the like in which said blank includes hingedly connected closure flap, cover panel, front panel, bottom panel and rear panel, and each of said panels having hingedly connected left and right end flaps and a membrane flap extending from each of the left and right front panel end flaps and the front panel, the steps for forming the carton include:

(a) erecting said front, bottom, cover and rear panels in a substantially vertical plane forming a substantially rectangular body having an upper and lower end, said body being formed such that said end flaps extend substantially in the same plane as the corresponding panels and said left and right end flap membranes and said front panel membrane extend perpendicular to the respective front panel and end flaps and front panel;

(b) folding inwardly said bottom panel end flap of said lower end of said box so that it is substantially perpendicular with said bottom panel, (c) folding inwardly said front panel end flap of said lower end so that it is substantially perpendicular to said front panel;

(d) folding inwardly said cover panel end flap of said lower end so that it is substantially perpendicular with said cover panel;

(e) folding said rear panel end flap of said lower end inwardly so that it is substantially perpendicular with said rear panel;

(f) securing said rear panel end flap of said lower end to at least one of the other lower end flaps and forming a pocket receiving at least a portion of said lower cover panel end flap adjacent said rear panel;

(g) biasing said end flaps of said upper end of said body outwardly;

(h) filling said body with ice cream or the like;

(i) folding said bottom panel end flap of the upper end of said body so that said bottom panel end flap removes any ice cream on said cover panel end flap of said upper end and said bottom panel end flap is perpendicular with said bottom panel;

(j) folding said front panel end flap inwardly so that it is perpendicular to said front panel;

(k) folding said cover panel end flap of said upper end inwardly so that it is perpendicular to said cover panel;

(l) folding said rear panel end flap inwardly so that it is perpendicular to said rear panel; and (m) securing said rear panel end flap of said upper end to at least one of the other upper end flaps and forming a pocket receiving at least a portion of said upper cover panel adjacent said rear panel.

63. A method as in claim 62, wherein the step of securing said rear panel end flaps includes the steps of:

(a) applying a single strip of adhesive vertically along a portion of at least said bottom panel end flaps; and (b) securing said rear panel end flaps to a portion of at least the corresponding bottom panel end flap.

64. A method as in claim 62, wherein the step of securing said rear panel includes the steps of:

(a) applying a single strip of adhesive vertically along a portion of said bottom panel end flaps and at least a portion of said front panel end flaps; and (b) securing said rear panel end flaps to a portion of said bottom panel end flaps and said front panel end flaps.

65. A method as in claim 62, wherein the step of folding said front panel end steps includes the step of:

(a) biasing the front panel end flap membranes upwardly into abutting contact with said cover panel.

* * * * *